US007270225B1

(12) United States Patent
Chang

(10) Patent No.: US 7,270,225 B1
(45) Date of Patent: Sep. 18, 2007

(54) DUAL COIN ACTUATION MECHANISM WITH ANGULARLY AND AXIALLY OFFSET COIN SLOTS AND RECESSES

(76) Inventor: Kil Jae Chang, T. PiCO. Korea Manufacturing, 321-37 Suksu, 2 Dong, Anyang City, Kyungdido (KR)

( * ) Notice: Subject to any disclaimer, the term of this patent is extended or adjusted under 35 U.S.C. 154(b) by 0 days.

(21) Appl. No.: 11/455,548

(22) Filed: Jun. 19, 2006

(51) Int. Cl.

| | |
|---|---|
| ***G07D 3/00*** | (2006.01) |
| ***G07F 11/00*** | (2006.01) |
| ***G07F 5/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/254; 194/232; 194/235; 194/236; 194/335; 194/338

(58) Field of Classification Search ..... 194/229, 194/232–237, 253, 254, 292, 334, 335, 338, 194/348, 255

See application file for complete search history.

(56) References Cited

U.S. PATENT DOCUMENTS

| | | | |
|---|---|---|---|
| 2,365,165 | A | 12/1944 | Bauman et al. |
| 2,491,900 | A | 12/1949 | Mihalek |
| 3,010,557 | A | 12/1961 | Weitzman |
| 3,195,706 | A | 7/1965 | Leonhart |
| 3,361,241 | A | 1/1968 | Hall |
| 3,403,765 | A | 10/1968 | Knickerbocker |
| 3,732,962 | A | 5/1973 | Hall |
| 4,509,631 | A | 4/1985 | Kim |
| 5,657,848 | A | 8/1997 | Schwarzli |
| 5,924,542 | A | 7/1999 | Schwarzli |
| 6,840,366 | B2 | 1/2005 | Sheng-Hsing |
| 2004/0003979 | A1 | 1/2004 | Santilli, Jr. et al. |
| 2004/0206602 | A1 | 10/2004 | Chang |
| 2005/0087423 | A1 | 4/2005 | Rasmussen |

FOREIGN PATENT DOCUMENTS

| | | |
|---|---|---|
| GB | 929396 | 6/1963 |

*Primary Examiner*—Patrick Mackey
*Assistant Examiner*—Jeffrey A Shapiro
(74) *Attorney, Agent, or Firm*—John R. Flanagan

(57) ABSTRACT

A dual coin mechanism for a vending machine includes a cover plate having a peripheral flange with first and second coin slots defined therein angularly and axially offset from one another about and along an axis defined by the cover plate, and first and second coin carrier wheels mounted for rotation about the axis relative to the cover plate and respectively having first and second coin recesses angularly and axially offset from one another about and along the axis. The axially offset relationships between the first and second slots, the first and second recesses and consequently first and second paths taken by first and second coins carried in the first and second recesses ensure that the first and second coins are not brought into alignment respectively with the second and first slots and thus are made inaccessible to a user during their travel along the first and second paths.

12 Claims, 5 Drawing Sheets

DUAL COIN ACTUATION MECHANISM WITH ANGULARLY AND AXIALLY OFFSET COIN SLOTS AND RECESSES

BACKGROUND OF THE INVENTION

1. Field of the Invention

The present invention generally relates to a coin actuation mechanism for a coin-operated vending machine and, more particularly, is concerned with a dual coin actuation mechanism with angularly and axially offset coin slots and recesses.

2. Description of the Prior Art

U.S. Pat. Nos. 5,657,848 and 5,924,542 to Schwarzli and U.S. Pat. Appln. Pub. No. 2004/0206602 to Chang disclose prior art examples of dual-coin actuation mechanisms for a vending machine. Each of these prior art disclosures teaches a dual-coin actuation mechanism which has a front cover plate, a central shaft mounted through the cover plate for rotation about a central axis defined by the cover plate, a handle disposed adjacent to and exterior of the cover plate and rigidly connected to an outer end of the central shaft, and a coin carrier wheel mounted for rotation with the central shaft relative to the cover plate. The cover plate has first and second coin slots defined therethrough so as to be angularly displaced from, but axially aligned with, one another in a common plane disposed normal to the axis of rotation of the central shaft. The carrier wheel has first and second coin recesses angularly spaced apart from one another on a same one face of the carrier wheel but axially aligned with one another along the axis of rotation in the same common plane as the coin slots and also aligned with the corresponding coin slots when the carrier wheel is in a home position where the user can deposit a coin into each of the coin recesses. When first and second coins have been deposited into the first and second coin recesses on the carrier wheel, the handle can be turned by a user causing rotation of the central shaft and carrier wheel such that the deposited coins are carried by the carrier wheel about a common circular path, along the common plane of the coin slots and recesses, from which path the coins, in succession, can exit the carrier wheel at a discharge location and fall into a coin collection box. Such rotation of the central shaft also causes a gear mounted to an opposite end of the central shaft to simultaneously actuate a dispensing mechanism to cause an item to be dispensed from the vending machine to the user.

A problem exists, however, with the design of these prior art mechanisms. The first and second coin slots and recesses, by being axially aligned with one another in the common plane, means that necessarily the path of the trailing or second coin at some point during the turning of the handle and rotation of the central shaft and carrier wheel passes the first coin slot where the second coin is accessible to and can be removed by the user without jamming the mechanism, which results in loss of revenue to the owner of the vending machine.

To overcome this problem, the dual coin mechanism of the Schwarzli patents employs a movable rocker bar which extends across the path of the first coin, into and from its first coin slot, and thus blocks access to the first coin slot as the trailing or second coin passes it to thereby prevent removal of the trailing or second coin therefrom. Such extension of the rocker bar automatically occurs only when the trailing or second coin in the second coin recess is brought into alignment with the first coin slot. At all other times the rocker bar is retracted from the path of the first coin to and from the first coin slot. The dual coin mechanism of the Chang published patent application employs a pivotally-mounted blocking latch that pivotally yields from a normal blocking position across the path of the first coin into and from its first coin slot to a position offset from the path of the first coin in response to insertion of the first coin into the first coin slot but does not pivotally yield from the normal blocking position in response to an attempt to remove the second coin from the first coin slot when the carrier wheel has placed the second coin recess in alignment with the first coin slot.

While these prior art devices appear to be satisfactory in use for the specific purposes for which they were designed, none of them seem to provide the optimum solution for the problem at hand. Consequently, a need still exists for a device which provides an alternative solution to the aforementioned problem in the prior art without introducing any new problems in place thereof.

SUMMARY OF THE INVENTION

The present invention provides a dual coin actuation mechanism designed to satisfy the aforementioned need. The dual coin actuation mechanism of the present invention provides first and second coin slots angularly and axially offset from one another about and along an axis of rotation and first and second coin carrier wheels that respectively have first and second coin recesses angularly and axially offset from one another about and along the axis of rotation. The axially offset relationships between the slots, between the recesses and thus between first and second paths taken by first and second coins, upon rotation of the carrier wheels, going from initial deposit positions, in which the first and second recesses are aligned correspondingly with first and second slots, to a discharge location, obviate the need to provide any blocking device adjacent to either of the slots in view that the first and second coin are not brought into alignment respectively with the second and first slots and thus made inaccessible to a user during their travel along the first and second paths.

Accordingly, the present invention is directed to a dual coin actuation mechanism which comprises: (a) a cover plate defining an axis and having a peripheral flange portion with first and second coin slots defined therein angularly and axially offset from one another about and along the axis; and (b) first and second coin carrier wheels mounted for rotation relative to the cover plate about the axis, the first and second coin carrier wheels respectively having first and second coin-receiving recesses angularly and axially offset from one another about and along the axis such that the axially offset first and second recesses are correspondingly aligned with the axially offset first and second slots when the first and second carrier wheels are at initial home positions in which first and second coins can be deposited through the first and second slots into the corresponding first and second recesses, the axially offset relationships between the first and second slots, between the first and second recesses and consequently between first and second side-by-side paths taken by the first and second coins carried in the first and second recesses of the first and second carrier wheels, upon rotation of the first and second carrier wheels from the initial home positions to a discharge location, ensure that the first and second coins as they are carried along the corresponding first and second paths are not brought into alignment respectively with the second and first slots and thus are made inaccessible to a user during travel of the first and second coins along the first and second paths.

Also, the actuation mechanism comprises first and second retainer plates attached to the cover plate. The first retainer plate is stationarily disposed between and adjacent to a rear side of the first carrier wheel and a front side of the second carrier wheel and the second retainer plate is stationarily disposed adjacent to a rear side of the second carrier wheel such that the first and second retainer plates respectively retain the first coin in the first recess of the first carrier wheel and the second coin in the second recess of the second carrier wheel as the first and second carrier wheels are rotated from their respective coin deposit positions to the discharge location.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
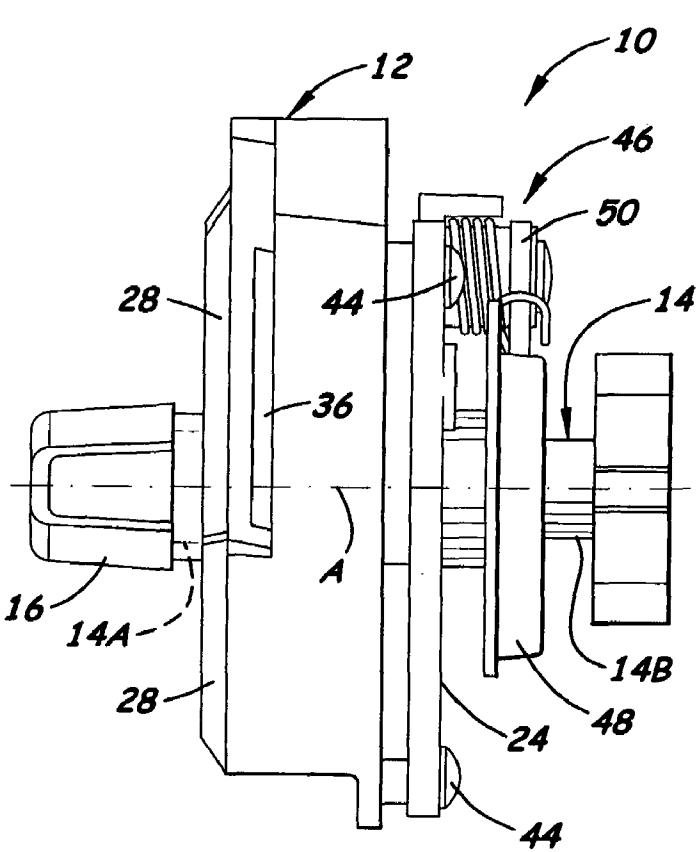
FIG. 2 is a right side elevational view of the actuation mechanism of FIG. 1.
Figure 1:
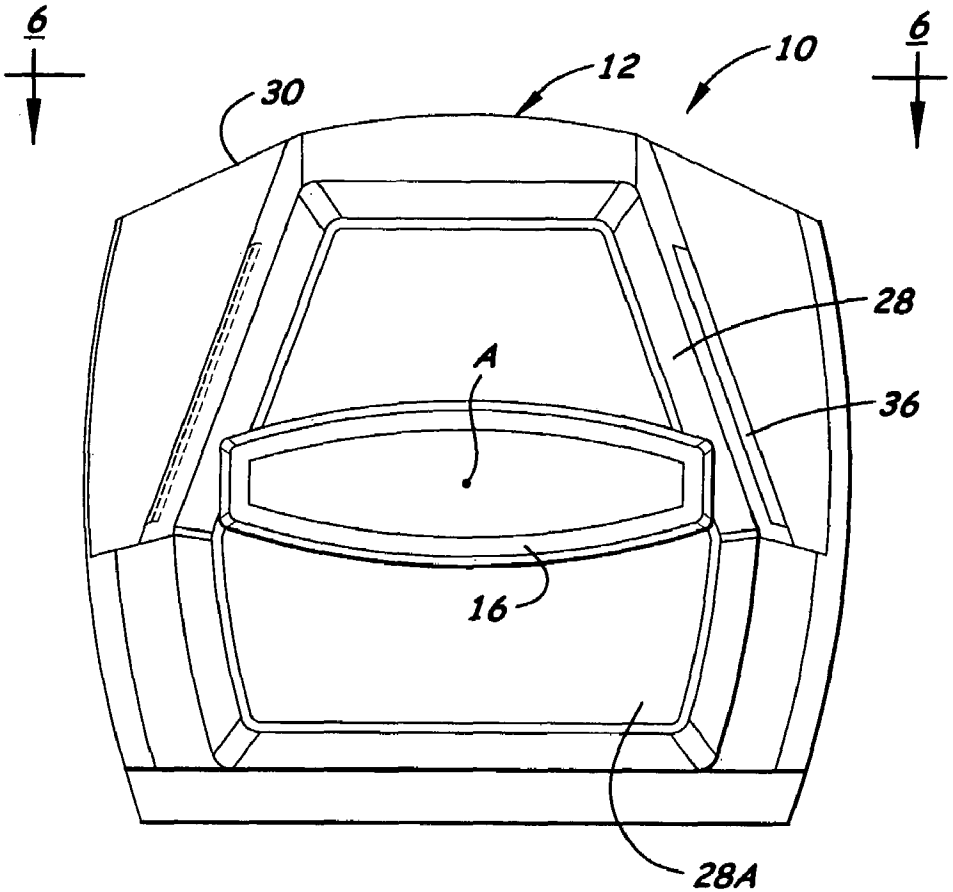
FIG. 1 is a front elevational view of a multiple coin actuation mechanism of the present invention.
Figure 4:
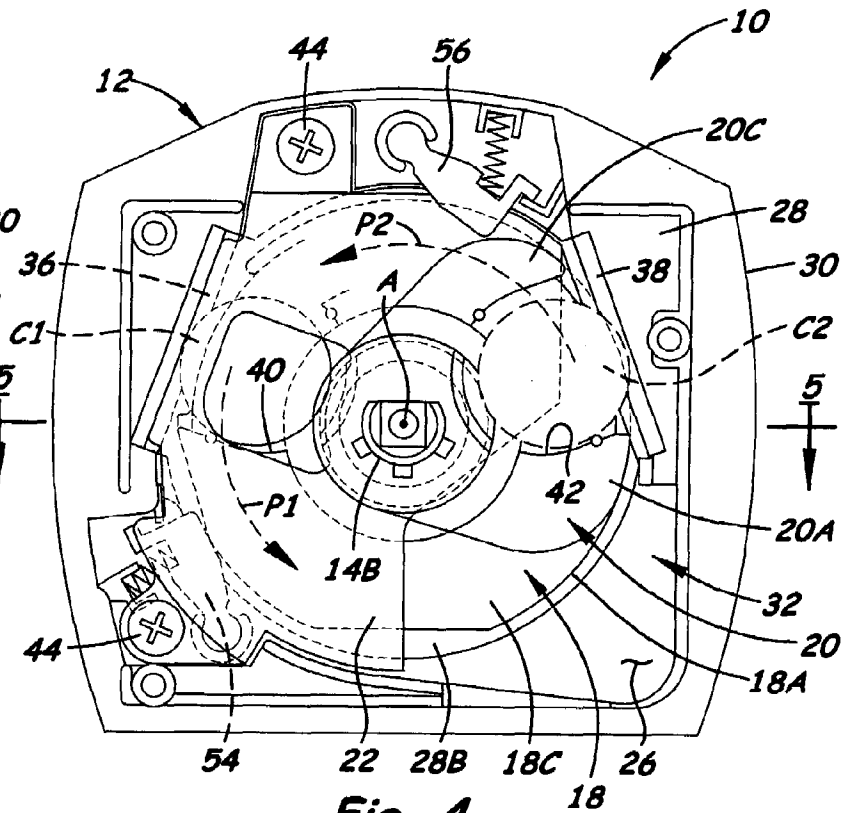
FIG. 4 is a rear elevational view of the actuation mechanism similar to that of FIG. 3 except with the rear one-way ratchet device and second retainer plate removed from the mechanism to expose first retainer plate and first and second coin carrier wheels shown in initial home positions and coins in phantom.

Referring to the drawings and particularly to FIGS. 1 to 5, there is illustrated a dual coin actuation mechanism, generally designated 10, of the present invention. The dual coin actuation mechanism 10 basically includes a face or cover plate 12, a central shaft 14, a transverse handle 16 attached to a front end 14A of the central shaft 14, first and second coin carrier wheels 18, 20, and first and second coin retainer plates 22, 24. At the outset, it should be understood that the terms "first" and "second" are used herein to identify elements at "leading" and "trailing" positions in relation to one another as they travel counterclockwise along respective separate paths P1, P2 about an axis A of the cover plate 12, as viewed in FIGS. 4 and 8-10, from initial coin-deposit home positions to a coin discharge location 26. Thus, for example, when viewed along the respective paths P1, P2, a first coin C1 is the leading coin by being closer to the coin discharge location 26 than is a second coin C2, the trailing coin.

The face or cover plate 12 of the actuation mechanism 10 has a central body 28 with front and rear faces 28A, 28B, and an outer flange 30 rigidly attached to and extending about a periphery of the central body 28 and projecting rearwardly from the rear face 28B thereof such that the central body 28 and its outer flange 30 together form a rear recessed cavity 32 at a rear side of the cover plate 12. The central body 28 has an opening 34 defined therein so as to extend between its front and rear faces 28A, 28B and about the axis A of the cover plate 12 defined by its central body 28. Also, as best seen in FIGS. 5 and 6, the cover plate 12 has first and second coin-receiving slots 36, 38 defined through substantially opposite side portions of the outer flange 30 such that the first and second slots 36, 38 are disposed in angularly displaced relation to one another about the axis A of the cover plate 12 and in separate planes D1, D2 axially spaced from one another along the axis A of the cover plate 12.

Figure 5:
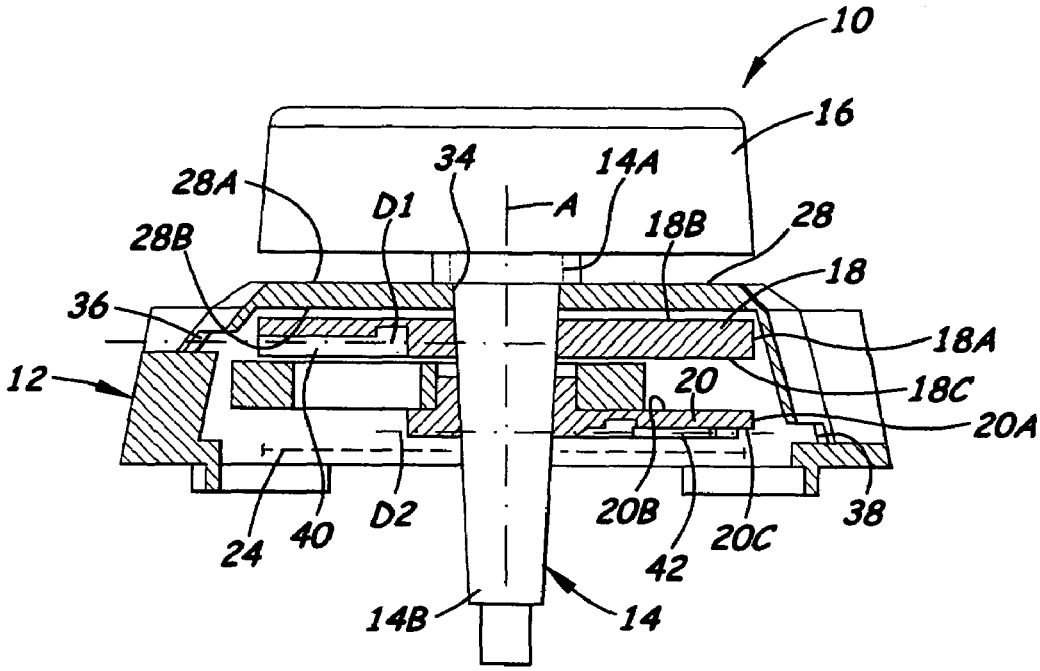
FIG. 5 is a cross-sectional view taken along line 5-5 in FIG. 4 showing first and second coin deposit slots defined in a peripheral flange portion of the cover plate and axially and angularly displaced from one another along and about an axis of the cover plate and also showing first and second coin-accepting recesses defined in respective rear faces or sides of the first and second carrier wheels axially and angularly displaced from one another along and about the axis of the cover plate such that the first and second recesses are aligned correspondingly with the first and second slots when the first and second carrier wheels are disposed in the initial home positions.
Figure 6:
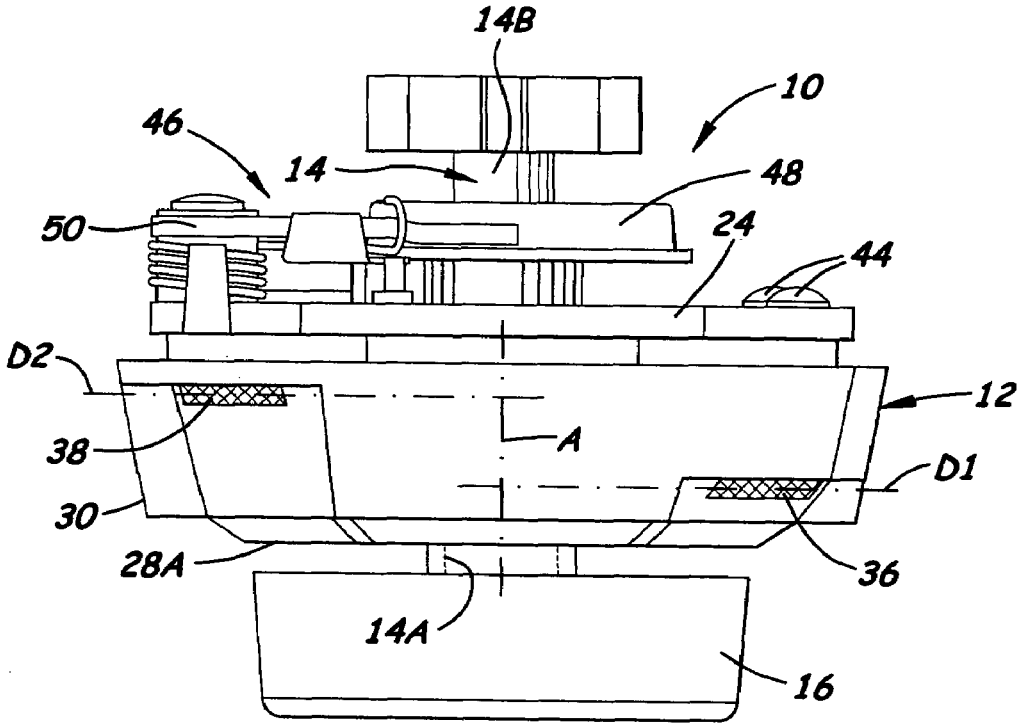
FIG. 6 is a diagrammatic representation of the actuation mechanism as seen along line 6-6 of FIG. 1 showing the angularly and axially offset locations of first and second coin slots in the peripheral flange portion of the cover plate relative to one another and to the axis of the cover plate.

As best seen in FIG. 5, the central shaft 14 of the actuation mechanism 10 extends from the front end 14A thereof, disposed adjacent to the front face 28A of the central body 28 of the cover plate 12, through the opening 34 in the central body 28 and through the rear recessed cavity 32 to a rear end 14B of the shaft 14 disposed rearwardly of the rear recessed cavity 32. The central shaft 14 is rotatably mounted to the cover plate 12 through the opening 34 and extends co-axially along the axis A of the cover plate 12. The handle 16 is disposed adjacent to the front face 28A of the central body 28 of the cover plate 12 and fixedly attached on the front end 14A of the shaft 14 such that the handle 16 may be turned by a user to rotate the shaft 14 about the axis A.

Figure 8:
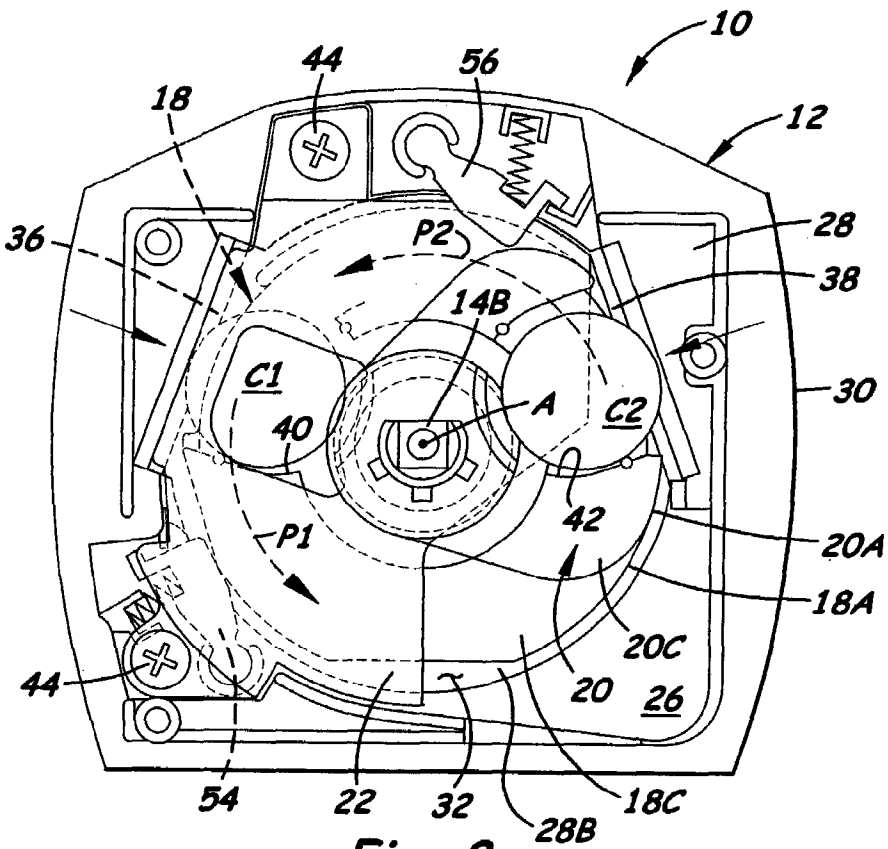
FIG. 8 is a rear elevational view similar to that of FIG. 4 but now showing depositing of first and second coins through axially offset first and second slots of the cover plate into respective first and second recesses of the carrier wheels with the second retainer plate and a portion of the first retainer plate removed.
Figure 7:
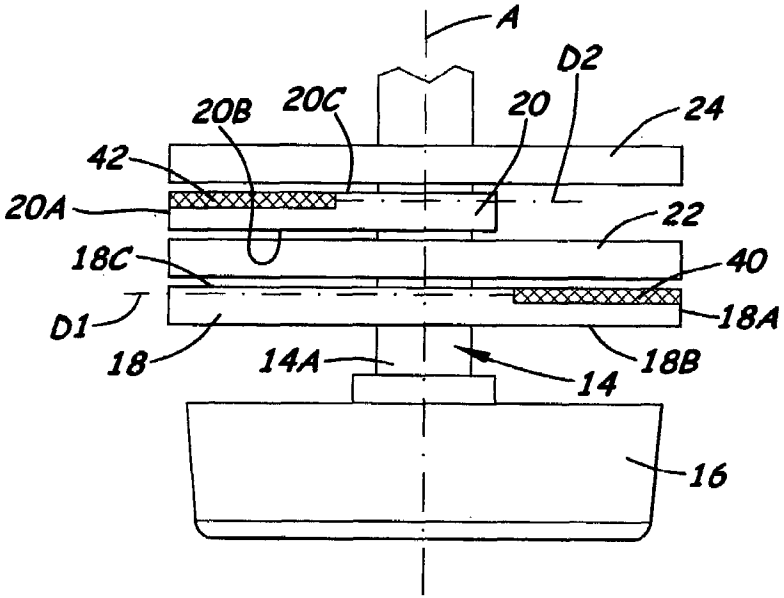
FIG. 7 is a diagrammatic representation of the actuation mechanism similar to FIG. 6 but with the cover plate removed to expose the angularly and axially offset relationship of the first and second coin-receiving recesses in the respective first and second carrier wheels.

As best seen in FIGS. 5 and 7, each of the first and second coin carrier wheels 18, 20 of the actuation mechanism 10 has a peripheral edge 18A, 20A and front and rear sides 18B, 20B and 18C, 20C. The carrier wheels 18, 20 interfit with and are mounted over the central shaft 14 such that they are disposed in the rear recessed cavity 32 of the cover plate 12 to undergo rotation with the shaft 14, upon the turning of the handle 16, relative to the cover plate 12 and about its axis A. As shown in FIGS. 4 and 8-10, whereas the first carrier wheel 18 is in the form of substantially a circular body, it will be noted that the second carrier wheel 20 is in the form of only about a fourth or fifth of a circular body. The first and second carrier wheels 18, 20 respectively have first and second coin-accepting recesses 40, 42 defined into respective rear sides 18C, 20C of the carrier wheels 18, 20 which also extend to and are open at the peripheral edges 18A, 20A thereof. The respective first and second recesses 40, 42 in the carrier wheels 18, 20 are axially and angularly displaced from one another respectively along and about the axis A and the central shaft 14 such that the axially and angularly offset first and second recesses 40, 42 are aligned correspondingly with the axially and angularly offset first and second slots 36, 38 when the carrier wheels 18, 20 are disposed at initial home positions. When the carrier wheels 18, 20 are at the home positions, as seen in FIG. 8, the first and second coins C1, C2 can be deposited through the first and second slots 36, 38 into the corresponding first and second recesses 40, 42.

The axially offset relationships between the first and second slots 36, 38, between the first and second recesses 40, 42 and consequently between first and second side-by-side paths P1, P2 taken by the first and second coins C1, C2 carried in the first and second recesses 40, 42 of the first and second carrier wheels 18, 20, upon rotation thereof from the initial home positions (as seen in FIG. 8) to the discharge location 26 (as seen respectively in FIGS. 9 and 10), ensure that the first and second coins C1, C2 as they are carried along the corresponding first and second paths P1, P2 are not brought into alignment respectively with the second and first slots 42, 40 and thus are made inaccessible to a user during the travel of the first and second coins C1, C2 along the first and second paths P1, P2, meaning that the user cannot withdraw the second coin C2 from the second recess 42 through the first coin slot 36.

Figure 10:
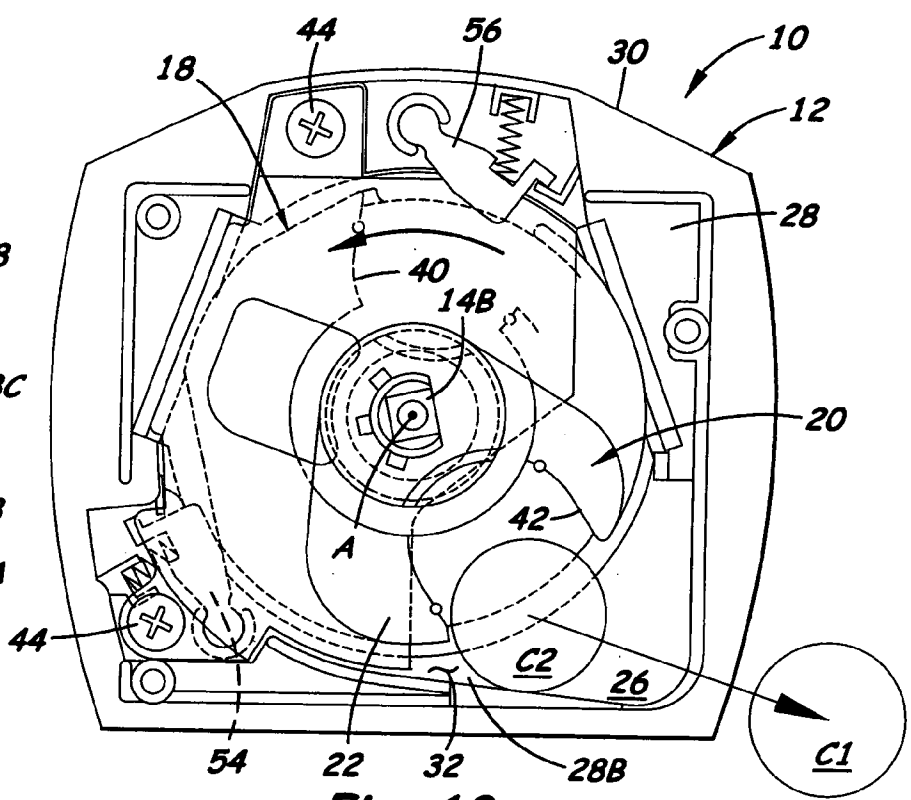
FIG. 10 is a rear elevational view similar to that of FIG. 9 but now showing the wheels further rotating in the counterclockwise direction such that the second coin carried by the second carrier wheel has reached the discharge location.
Figure 9:
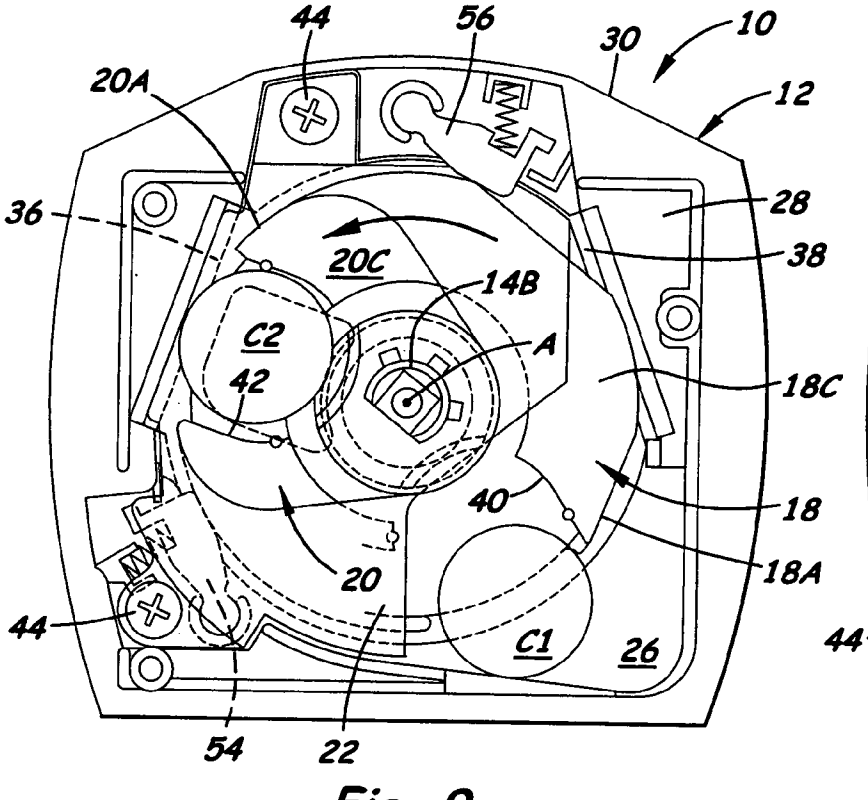
FIG. 9 is a rear elevational view similar to that of FIG. 8 but now showing the carrier wheels rotating counterclockwise such that the first coin carried by the first carrier wheel has reached the discharge location as the second coin carried by the second carrier wheel is passing behind or rearwardly of the first coin slot.

The first and second coin retainer plates 22, 24 are attached to the cover plate 12 by a plurality of screws 44 and extend across the rear recessed cavity 32 of the cover plate 12 so as to respectively stationarily dispose the first retainer plate 22 between and adjacent to the rear side 18C of the first carrier wheel 18 and the front side 20B of the second carrier wheel 20 and stationarily dispose the second retainer plate 24 adjacent to the rear side 20C of the second carrier wheel 20 such that the first and second retainer plates 22, 24 respectively retain the first coin C1 in the first recess 40 of the first carrier wheel 18 and the second coin C2 in the second recess 42 of the second carrier wheel 20 as the first and second carrier wheels 18, 20 are rotated with the shaft 14, by turning the handle 16, from the respective initial deposit positions (as seen in FIG. 8) to the discharge location 26 (as seen in FIGS. 9 and 10). The paths P1, P2 taken by the first and second coins C1, C2 carried in the respective first and second recesses 40, 42 of the first and second carrier wheels 18, 20 by being axially offset from one another and disposed in the separate planes D1, D2 of the first and second slots 36, 38, due to the axially spaced relationship of the first and second carrier wheels 18, 20 with respect to one another and the first and second coins C1, C2 after leaving the first and second slots 36, 38 by being continuously covered by the outer flange 30 of the cover plate 12, preclude withdrawal of the coins C1, C2 from the first and second carrier wheels 18, 20 through the second and first slots 36, 38 during their travel along the paths P1, P2 from the coin deposit positions to the coin discharge location 26.

Figure 3:
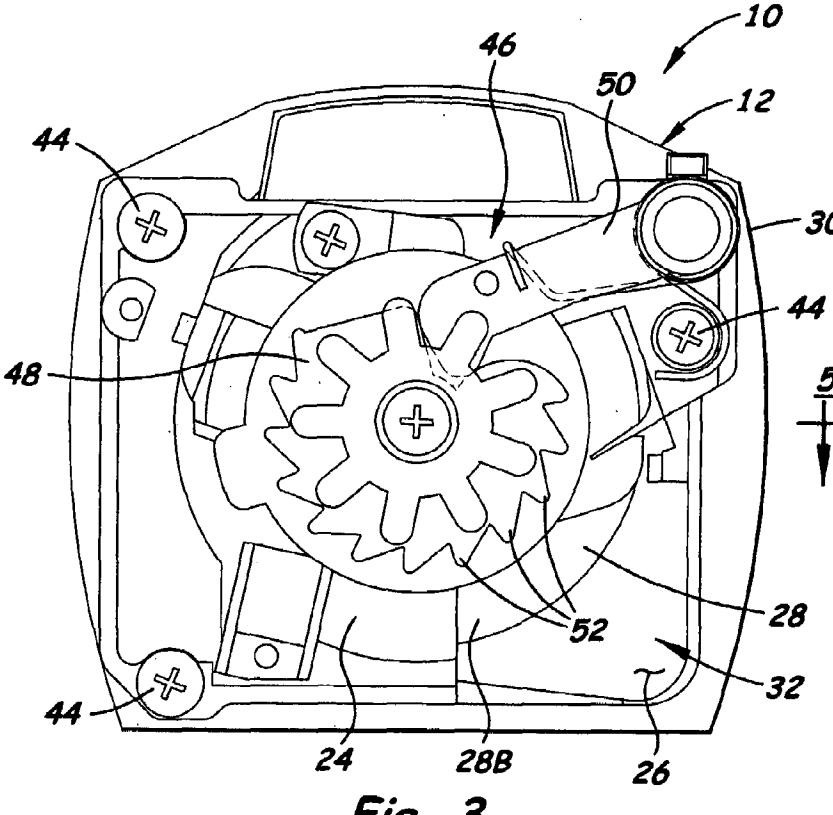
FIG. 3 is a rear elevational view of the actuation mechanism of FIG. 1.

Referring to FIGS. 2 and 3, the actuation mechanism 10 also includes a ratchet device 46 including a ratchet wheel 48 fixedly mounted to the rear end 14B of the central shaft 14 and a spring-loaded pawl 50 pivotally mounted to the second retainer plate 24 adjacent to the ratchet wheel 48. The pawl 50 is positioned to engage in succession notches 52 defined about the ratchet wheel 48 such that the central shaft 14, ratchet wheel 48 and first and second carrier wheels 18, 20 can only be rotated in the counterclockwise direction once that the shaft 14 has rotated sufficiently to bring the pawl 50 into engagement with a first of the notches 52 on the ratchet wheel 48 which then prevents reverse rotation of the shaft 14, ratchet wheel 48 and first and second carrier wheels 18, 20. The actuation mechanism 10 further includes first and second detents 54, 56 movably mounted to the cover plate 12 and adapted to respectively engage the first and second carrier wheels 18, 20 and cooperating with the first and second coin recesses 40, 42, by engaging therein, to prevent rotation of the carrier wheels 18, 20 away from the initial home positions until the first and second coins C1, C2 have been deposited into the first and second coin recesses 40, 42. The detents 54, 56 also are adapted to ride over the first and second coins C1, C2 when deposited in the first and second coin recesses 40, 42 and thus not engage within the first and second recesses 40, 42 of the carrier wheels 18, 20 when the first and second coins C1, C2 are deposited therein.

Turning now to FIGS. 8-10, there is shown examples of several successive positions of the first and second carrier wheels 18, 20 in their travel along paths P1, P2 from their initial home positions in which their recesses 40, 42 are aligned with the corresponding slots 36, 38 for receiving the first and second coins C1, C2, to where their recesses 40, 42 and the coins C1, C2 therein, in succession, reach the discharge location 26. FIG. 8 shows depositing of first and second coins C1, C2 through the axially offset first and second slots 36, 38 of the cover plate 12 into corresponding first and second recesses 40, 42 of the carrier wheels 18, 20. FIG. 9 shows the carrier wheels 18, 20 having been rotated counterclockwise along the respective paths P1, P2 to where the first coin C1 carried by the first carrier wheel 18 has now reached the discharge location 26 as the second coin C2 carried by the second carrier wheel 20 is passing behind or rearwardly of the first coin slot 36. FIG. 10 shows the carrier wheels 18, 20 having further rotated counterclockwise along the respective paths P1, P2 to where the second coin C2 carried by the second carrier wheel 20 has now reached the discharge location 26. Continued rotation of the handle 16 and the shaft 14 and carrier wheels 18, 20 returns them to the initial home position.

It should be understood that herein the use of the term "dual" is not intended as a limitation in regard to the number of coins that can be accepted by the mechanism since each of the coin slots and recesses can be readily modified in width and depth respectively to accommodate more than one coin so that multiple coins can be employed with the dual coin mechanism. The term "dual" is meant in the sense that there are at least two coin slots and coin recesses provided in the components of the mechanism.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A dual coin mechanism for a vending machine, said mechanism comprising:

(a) a cover plate defining an axis and having a peripheral flange portion with first and second coin slots defined therein angularly and axially offset from one another about and along said axis; and (b) first and second coin carrier wheels mounted for rotation about said axis relative to said cover plate, said first and second carrier wheels correspondingly having first and second coin-receiving recesses angularly and axially offset from one another respectively about and along said axis such that said angularly and axially offset first and second recesses are correspondingly aligned with said angularly and axially offset first and second slots when said carrier wheels are disposed at initial home positions at which first and second coins can be deposited through said first and second slots into said corresponding first and second recesses, said axially offset relationships between said first and second slots, between said first and second recesses and consequently between first and second side-by-side paths taken by the first and second coins carried in said first and second recesses of said first and second carrier wheels, upon rotation of said first and second carrier wheels from said initial home positions to a discharge location, ensure that the first and second coins as they are carried along said corresponding first and second paths are not brought into alignment respectively with said second and first slots and thus are made inaccessible to a user during the travel of the first and second coins along said first and second paths.

2. The actuation mechanism of claim 1 further comprising:

first and second retainer plates attached to said cover plate, said first retainer plate being stationarily disposed between and adjacent to a rear side of said first carrier wheel and a front side of said second carrier wheel, said second retainer plate being stationarily disposed adjacent to a rear side of said second carrier wheel such that said first and second retainer plates respectively retain the first coin in said first recess of said first carrier wheel and the second coin in said second recess of said second carrier wheel as said first and second carrier wheels are rotated from their respective coin deposit positions to said discharge location.

3. The actuation mechanism of claim 1 further comprising:

a shaft extending from a front end thereof, disposed adjacent to a front face of said cover plate, through an opening through said cover plate to a rear end thereof disposed rearwardly from a rear face of said cover plate, said shaft being rotatably mounted to said cover plate along said axis and said carrier wheels being mounted to said shaft so as to undergo rotation with said shaft relative to said cover plate and about said axis and between said initial home positions and said discharge location.

4. The actuation mechanism of claim 3 further comprising:

a handle disposed adjacent to said front side of said cover plate and fixedly attached on said forward end of said shaft such that said handle may be turned by the user to rotate said shaft and carrier wheels therewith about said axis.

5. The actuation mechanism of claim 4 further comprising:

first and second retainer plates attached to said cover plate, said first retainer plate being stationarily disposed between and adjacent to a rear side of said first carrier wheel and a front side of said second carrier wheel, said second retainer plate being stationarily disposed adjacent to a rear side of said second carrier wheel such that said first and second retainer plates respectively retain the first coin in said first recess of said first carrier wheel and the second coin in said second recess of said second carrier wheel as said first and second carrier wheels are rotated with said shaft, by turning said handle, from their respective coin deposit positions to said discharge location.

6. The actuation mechanism of claim 5, further comprising:

a ratchet device including a ratchet wheel fixedly mounted to said rearward end of said shaft and a spring-loaded pawl pivotally mounted to said second retainer plate adjacent to said ratchet wheel so as to engage in succession notches defined about said ratchet wheel such that said shaft, ratchet wheel and first and second carrier wheels can only be rotated in said counterclockwise direction once said shaft has rotated sufficiently to bring said pawl into engagement with a first of said notches on said ratchet wheel which then prevents reverse rotation of said shaft, ratchet wheel and first and second carrier wheels.

7. The actuation mechanism of claim 1 further comprising:

first and second means for respectively engaging said first and second carrier wheels and cooperating with said first and second coin recesses to prevent rotation of said carrier wheels away from said initial home positions until first and second coins have been deposited into said first and second coin recesses.

8. The actuation mechanism of claim 7 wherein said first and second means for respectively engaging said first and second carrier wheels respectively are first and second detents movably mounted to said cover plate and adapted to engage into said first and second coin recesses, said detents also adapted to ride over the first and second coins when deposited in said first and second coin recesses and thus not engage with said first and second recesses of said first and second carrier wheels when the first and second coins are deposited therein.

9. A dual coin actuation mechanism for a vending machine, said actuation mechanism comprising:

(a) a cover plate having (i) a body with front and rear faces and an opening defined through said body so as to extend between said front and rear faces thereof and about an axis defined by said body, (ii) an outer flange attached to and extending about a periphery of said body and projecting rearwardly from said rear face thereof such that said cover plate and outer flange together form a rear recessed cavity at a rear side of said body, and (iii) first and second coin-receiving slots defined through portions of substantially opposite sides of said outer flange such that said first and second slots are disposed in angularly displaced relation to one another about said axis of said body of said cover plate and in separate planes axially spaced from one another along said axis of said body;

(b) a shaft extending from a front end thereof, disposed adjacent to said front face of said cover plate, through said opening of said cover plate and rear recessed cavity therein to a rear end of said shaft disposed rearwardly of said rear recessed cavity of said cover plate, said shaft being rotatably mounted to said cover plate along said axis and said carrier wheels being fixedly mounted to said shaft for undergoing rotation with said shaft relative to said cover plate and about said axis;

(c) a handle disposed adjacent to said front side of said cover plate and fixedly attached on said front end of said shaft such that said handle may be turned by the user to rotate said shaft and carrier wheels therewith about said axis;

(d) first and second coin carrier wheels each having a peripheral edge and front and rear sides and being disposed in said rear recessed cavity of said cover plate and mounted to said shaft so as to undergo rotation therewith, said front and rear carrier wheels respectively having first and second coin-accepting recesses defined on said respective rear sides of said carrier wheels and open at said peripheral edges thereof, said respective first and second recesses in said carrier wheels being axially and angularly displaced from one another respectively along and about said shaft such that said axially and angularly offset first and second recesses are aligned correspondingly with said axially and angularly offset first and second slots when said carrier wheels are disposed at initial home positions at which first and second coins can be deposited through said first and second slots into said corresponding first and second recesses, said axially offset relationships between said first and second slots, between said first and second recesses and consequently between first and second side-by-side paths taken by the first and second coins carried in said first and second recesses of said first and second carrier wheels, upon rotation of said first and second carrier wheels from said initial home positions to a discharge location, ensure that the first and second coins as they are carried along said corresponding first and second paths are not brought into alignment respectively with said second and first slots and thus are made inaccessible to a user during the travel of the first and second coins along said first and second paths; and (e) first and second retainer plates attached to said cover plate and extending across said rear recessed cavity so as to respectively stationarily dispose said first retainer plate between and adjacent to said rear side of said first carrier wheel and said front side of said second carrier wheel and stationarily dispose said second retainer plate adjacent to said rear side of said second carrier wheel such that said first and second retainer plates respectively retain the first coin in said first recess of said first carrier wheel and the second coin in said second recess of said second carrier wheel as said first and second carrier wheels are rotated with said shaft, by turning said handle, from said respective initial deposit positions to said discharge location, said paths taken by the first and second coins carried in said respective first and second recesses of said first and second carrier wheels being axially offset from one another and disposed in said separate planes of said first and second slots due to the axially spaced relationship of said first and second carrier wheels with respect to one another and the first and second coins after leaving said first and second slots by being continuously covered by said outer flange of said cover plate preclude withdrawal of said coins from said first and second carrier wheels through said first and second slots during their travel along said paths from said coin deposit positions to the coin discharge location.

10. The actuation mechanism of claim 9, further comprising:

a ratchet device including a ratchet wheel fixedly mounted to said rearward end of said shaft and a spring-loaded pawl pivotally mounted to said second retainer plate adjacent to said ratchet wheel so as to engage in succession notches defined about said ratchet wheel such that said shaft, ratchet wheel and first and second carrier wheels can only be rotated in said counterclockwise direction once said shaft has rotated sufficiently to bring said pawl into engagement with a first of said notches on said ratchet wheel which then prevents reverse rotation of said shaft, ratchet wheel and first and second carrier wheels.

11. The actuation mechanism of claim 9 further comprising:

first and second means for respectively engaging said first and second carrier wheels and cooperating with said first and second coin recesses to prevent rotation of said carrier wheels away from said initial home positions until first and second coins have been deposited into said first and second coin recesses.

12. The actuation mechanism of claim 11 wherein said first and second means for respectively engaging said first and second carrier wheels respectively are first and second detents movably mounted to said cover plate and adapted to engage into said first and second coin recesses, said detents also adapted to ride over the first and second coins when deposited in said first and second coin recesses and thus not engage with said first and second recesses of said first and second carrier wheels when the first and second coins are deposited therein.

* * * * *